US005079933A

United States Patent [19]

Alviti

[11] Patent Number: 5,079,933

[45] Date of Patent: Jan. 14, 1992

[54] PLASTIC EAR CLIP

[76] Inventor: Steven R. Alviti, 16 Captain Freebody Rd., Narragansett, R.I. 02882

[21] Appl. No.: 673,348

[22] Filed: Mar. 22, 1991

[51] Int. Cl.[5] ..... A44C 7/00

[52] U.S. Cl. ..... 63/14.5; 63/DIG. 3

[58] Field of Search ..... 63/14.1, 14.4, 14.5, 63/14.8, DIG. 3

[56] References Cited

U.S. PATENT DOCUMENTS

| | | | |
|---|---|---|---|
| 857,105 | 6/1907 | Patten | 63/14.4 |
| 2,013,760 | 9/1935 | McSoley | 63/14.1 |
| 2,364,872 | 12/1944 | Rich | 63/DIG. 1 X |
| 2,583,988 | 1/1952 | Ballou et al. | 63/14.5 X |
| 2,733,491 | 2/1956 | Saccoccio | 63/14.5 X |
| 2,743,498 | 5/1956 | McVinney | 63/14.5 X |
| 2,764,881 | 10/1956 | Evans | 63/14.5 |
| 2,841,853 | 7/1958 | Guyot | 63/14.1 X |
| 3,082,431 | 3/1963 | Watts | 63/14.1 X |
| 4,059,971 | 11/1977 | Shoji | 63/14.1 |
| 4,538,429 | 9/1985 | Bradford | 63/DIG. 3 |

FOREIGN PATENT DOCUMENTS

| | | | |
|---|---|---|---|
| 216524 | 6/1956 | Australia | 63/DIG. 3 |

*Primary Examiner*—Gary L. Smith
*Assistant Examiner*—Jerry Redman
*Attorney, Agent, or Firm*—Barlow & Barlow, Ltd.

[57] ABSTRACT

An ear clip is molded from a plastic material and has two arms hinged together. The arms are each attached to a curved link by hinges. The link expands and contracts between its two ends maintaining the arms in one of two positions and urges the arms to return to one of two positions.

5 Claims, 1 Drawing Sheet

PLASTIC EAR CLIP

This invention relates to the jewelry art and more particularly to a novel ear clip construction. Earrings constructed in the past which have been used on non-pierced ears have generally comprised an ornament with some form of a mechanical spring clip. There have also been screw-type clamping elements as well as slightly springy U-shaped members which fit around the lobe of the ear. One of the problems in the prior art has been to have an ear clip that is comfortable so that a person can wear it for a long period of time. Difficulties that have been found in the prior art are due primarily to improper adjustment of the spring action of the metallic clips and/or fatigue of the metal parts.

In addition, and particularly with post earrings, users often experience chronic or swelling and discomfort as the hole through the ear lobe may become irritated by the connection on the back of the decorative part of the earring which may be made of a metal other than gold or surgical steel.

SUMMARY OF THE INVENTION

According to the present invention, the earring construction comprises a non-metallic ear clip which is adapted to embrace the lobe of an ear with a clamping action and which eliminates the possibility of infection. The ear clip consists of a pair of non-metallic arms that are hinged to each other and which have a curved link hinged to each arm on a hinge line that is spaced from the main hinge line that connects the first and second arms. The curved link essentially has two states of equilibrium; that is to say either in an open position where the arms are apart or, in a closed position where the arms substantially join at their outer ends. Essentially therefore, the curved link undergoes expansion and contraction with the arms to which it is attached on either side of a hinge line and forms a clip which is readily moldable.

Accordingly, it is the primary object of the instant invention to provide a simple and effective plastic ear clip which can be operated in the same manner that ear clips of the prior art are operated, namely with a finger to open the same.

Another object of the instant invention is to provide a single unitary integral structure molded of plastic material which incorporates a snap action gripping means.

A still further object of the invention is to provide a molded plastic structure which utilizes a plurality of interacting hinges that co-act with jaw members for selective and resilient self-retention of the jaw members in open or closed position.

DESCRIPTION OF THE PREFERRED EMBODIMENT

Figure 1:
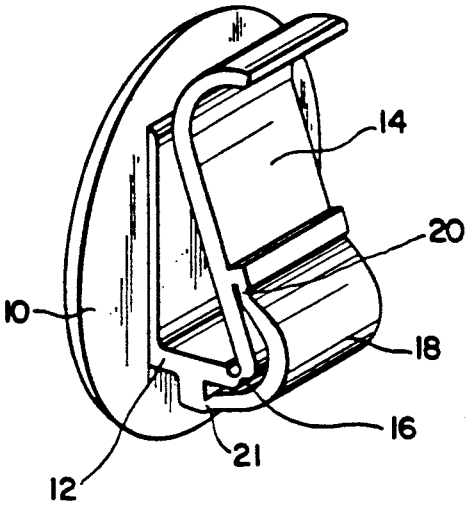
FIG. 1 is a side elevational view of one form of ear clip made in accordance with the invention.
Figure 3:
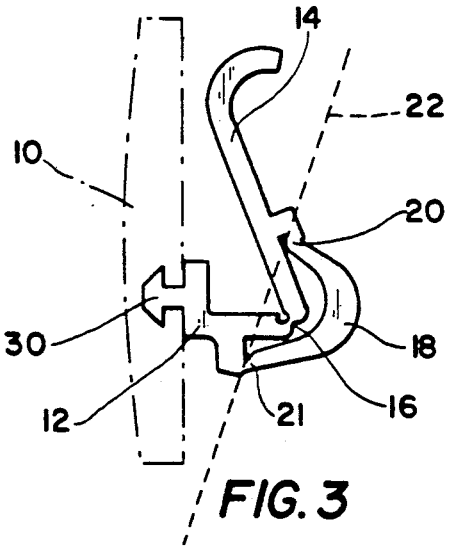
FIG. 3 is a third form thereof.
Figure 4:
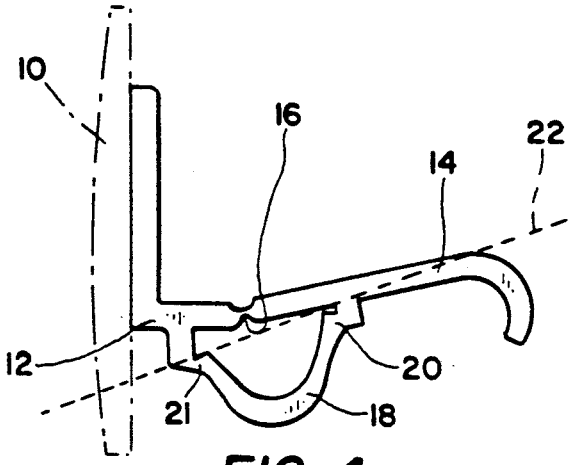
FIG. 4 is a side elevational view showing the ear clip in open position.
Figure 5:
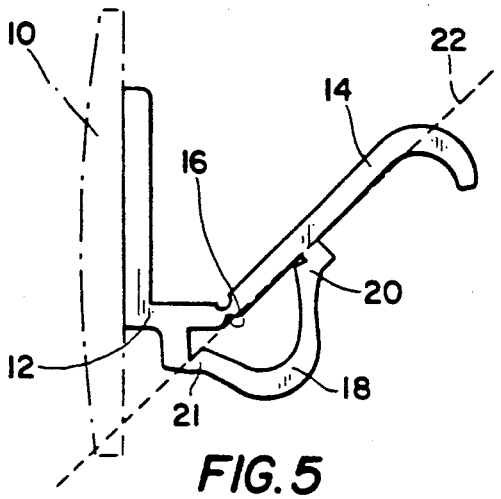
FIG. 5 is a view showing the ear clip in an intermediate angular position.

The ear clip of the invention is used to secure ear ornaments such as are generally indicated at 10 to the ear lobe of a wearer. The ear clip generally consists of an member molded as a single unit from a suitable resin and which is composed of two arms 12 and 14 that are joined by a relatively thin web portion 16. A curved link 18 is joined to both arms through thin web portions 20, 21. Also as part of the construction, the curved link will in all positions extend to one side of a line joining the two hinge lines 20 and 21 as seen by the broken line 22. It will be noted that the curved link has a length that is considerably longer than the distance between the hinge lines 20 and 21. The curved link operates as a snap hinge since the hinge line 16 extends from a position as seen in FIG. 1, which is to one side of the imaginary line 22 connecting the two hinge lines of the connecting link, to a point as seen in FIG. 3 where the hinge line 16 is on the other side of the imaginary line 22. Thus, at any point in between, the two states of equilibrium, which are essentially stable, there is a force exerted on the two legs 12 and 14 attempting to move them. Thus, when the hinge line 16 passes the line 22 toward the inner arc of the curved link, there will be a definitive closing action exerted by the curved link.

The practical utility and operation of the invention will be apparent. The ear clip, having been molded as an integral structure with an elastomeric plastic is ready for use in the position as shown in FIG. 1. The clip is gripped between the ornament and the point adjacent the hinge line 20 and a pinching pressure is applied. This then will cause the two arms to snap into open position. Closing of the arms is accomplished merely by a second pinching pressure between the ornament and the arm 14.

Figure 2:
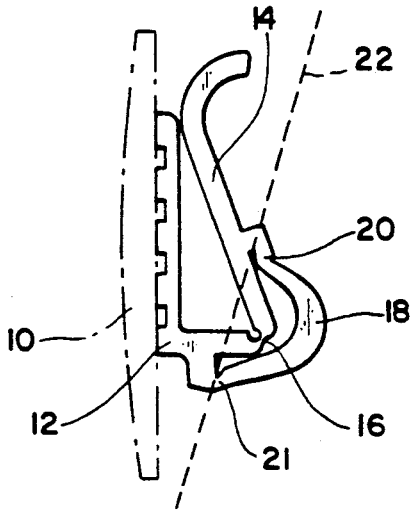
FIG. 2 is a second form thereof.

FIG. 2 illustrates the fact that the ornament may be attached in other fashions as by having a stud 30 acting as an extension of the arm 12 which may be molded integral with the ornament. Other forms will be obvious to those skilled in the art.

The clip of this construction lends itself to be extruded or otherwise molded from materials such as high density polyethylene, polypropylene and the like. Polypropylene is uniquely suitable because the flexure of a plastic such as this increases in tensile and tearing strength during use which creates a clip that has a long longevity. It will therefore be understood that the improved ear clip achieves the several objects of the invention and is well adapted to the conditions of daily use. The clip of this construction is not only very comfortable to wear but is also made from plastic materials that are vastly superior to brass or gold plated metals and will not react with the oils of the skin in any way whatsoever. In the trade this means that the earring is "hypo-allergenic".

I claim:

1. A plastic ear clip molded as a single unit comprising an ornament, a pair of arms, said ornament affixed to a first arm, said first arm hinged to a second arm on a first hinge line, a curved link hinged to each arm on link hinge lines spaced from the first hinge line, said arms having a first open and second closed positions, said positions exhibiting minimum stress in the curved link, said link in the first position being deformed above the first hinge line and in the second position lying adjacent the first hinge line whereby departures from said first or second position results in a deformed link and unstable equilibrium causing movement of the arms toward and away from each other.

2. An ear clip as in claim 1 wherein the first arm has two portions, one portion secured to the ornament and the other having the link hinge.

3. An ear clip as in claim 1 wherein the link hinge line on the first arm is closer to the arm hinge line that the link hinge line on the second arm.

4. A plastic ear clip molded as a single unit having a pair of arms joined by a thin web section, a curved link connected at one end by a thin web section to a first arm and at the other end by a thin web section to a second arm, the first arm having an arcuate outwardly extending terminal end, the second arm affixed to an ornament, the thin web sections of said link lying on an imaginary line on one side of the web section joining the arms when in closed position and on the other side thereof when in an open position to define two states of equilibrium.

5. A plastic ear clip molded as a single unit comprising an ornament, a pair of arms, said ornament affixed to a first arm, a second arm hinged to the first arm about a first hinge line, a curved resilient link joined at one end of the first arm at a second hinge line and joined at the other end integrally to the second arm on a third hinge line.

* * * * *